US007648214B2

(12) United States Patent
Chen et al.

(10) Patent No.: US 7,648,214 B2
(45) Date of Patent: Jan. 19, 2010

(54) POSITIONING DEVICE FOR DRAWER SLIDE BEARING CARRIER

(75) Inventors: Ken-Ching Chen, Kaohsiung Hsien (TW); Shin-Long Hwang, Kaohsiung Hsien (TW); Shun-Ho Yang, Kaohsiung Hsien (TW); Chun-Chiang Wang, Kaohsiung Hsien (TW)

(73) Assignee: King Slide Works Co., Ltd., Kaosiung Hsien (TW)

( * ) Notice: Subject to any disclaimer, the term of this patent is extended or adjusted under 35 U.S.C. 154(b) by 673 days.

(21) Appl. No.: 11/406,315

(22) Filed: Apr. 19, 2006

(65) Prior Publication Data

US 2006/0244349 A1 Nov. 2, 2006

(30) Foreign Application Priority Data

May 2, 2005 (TW) ..... 94114194 A

(51) Int. Cl.
*A47B 88/04* (2006.01)

(52) U.S. Cl. ..... 312/334.47; 312/333

(58) Field of Classification Search ..... 312/330.1, 312/319.1, 333, 334.1, 334.7, 334.8, 334.44, 312/334.46, 334.47, 334.11; 384/18, 20, 384/21, 22

See application file for complete search history.

(56) References Cited

U.S. PATENT DOCUMENTS

| | | | | |
|---|---|---|---|---|
| 3,801,166 | A | 4/1974 | York | |
| 4,252,382 | A | 2/1981 | Thomas | |
| 5,466,060 | A | 11/1995 | Hoffman | |
| 5,577,821 | A | 11/1996 | Chu | |
| 5,722,750 | A | 3/1998 | Chu | |
| 6,145,945 | A | 11/2000 | Parvin | |
| 6,220,683 | B1 | 4/2001 | Chu | |
| 6,254,210 | B1 | 7/2001 | Parvin | |
| 6,296,338 | B1 | 10/2001 | Stijns | |
| 6,390,575 | B1 | 5/2002 | Chen et al. | |
| 6,454,372 | B1 | 9/2002 | Yang | |
| 6,585,335 | B2 * | 7/2003 | Hwang et al. | 312/333 |
| 6,655,763 | B2 | 12/2003 | Judge et al. | |
| 6,705,689 | B2 * | 3/2004 | Chen et al. | 312/334.46 |
| 6,715,851 | B1 | 4/2004 | Yang | |
| 6,820,954 | B2 | 11/2004 | Judge et al. | |

(Continued)

FOREIGN PATENT DOCUMENTS

| | | |
|---|---|---|
| JP | 5-15790 | 4/1993 |

(Continued)

*Primary Examiner*—James O Hansen
(74) *Attorney, Agent, or Firm*—Rosenberg, Klein & Lee

(57) ABSTRACT

A positioning device for a drawer slide bearing carrier includes a bearing carrier having rollers located between a carrying rail and a sliding rail. The bearing carrier has a recess and a hook portion at a front end thereof. The carrying rail has a support at a front end thereof. The support comprises a hook unit which is pivotally connected to a block fixed on the carrying rail. An elastic force is formed between the support and the hook unit, urging the hook unit to restore its original position. Thereby, the front end of the bearing carrier is pressed by the block so that the hook portion engages with the hook unit to secure the bearing carrier in place. The carrying rail further comprises a releasing mechanism adapted to control the swing of the hook unit for the movement of different locations.

10 Claims, 19 Drawing Sheets

U.S. PATENT DOCUMENTS

| | | | |
|---|---|---|---|
| 6,851,773 | B2 | 2/2005 | Chen et al. |
| 6,860,574 | B2 | 3/2005 | Hwang et al. |
| 2002/0089273 | A1 | 7/2002 | Weng |
| 2005/0017613 | A1 | 1/2005 | Cirocco |
| 2005/0062379 | A1 | 3/2005 | Judge |

FOREIGN PATENT DOCUMENTS

| | | |
|---|---|---|
| JP | 2562231 | 11/1994 |
| TW | 491055 | 6/2002 |
| TW | 200412881 | 8/2004 |
| TW | M268985 | 7/2005 |

* cited by examiner

POSITIONING DEVICE FOR DRAWER SLIDE BEARING CARRIER

BACKGROUND OF THE INVENTION

1. Field of the Invention

This invention relates to a positioning device for a drawer slide bearing carrier, in particular to one that secures a bearing carrier in place by means of a hook unit along with a releasing mechanism to restore the drawer slide when it is pulled to the extreme position. The releasing mechanism controls the swing of the hook unit for the movement of different locations.

2. Description of the Related Prior Art

A slide used for a drawer or similar object is usually comprised of two or three sections of sliding rails to slide on those rails by means of one set or two sets of bearing mounted among those rails. A bearing carrier is provided to contain rollers to roll on the rails for the bearing carrier to movably connect to the sliding rails. Whereas it is necessarily in most cases to remove the drawer or similar object mounted on the slide by the furniture manufacturer or the consumer, the slide is provided with the function of disengaging the drawer or similar object from the slide, either in the configuration of two or three sections, essentially by pulling out the rails connected to the drawer or similar object. To consider the necessity of restoring the drawer or similar object to the slide and maintain the normal mechanism of the product, the bearing carrier providing the connection by sliding must be located at the front end of a fixed rail upon pulling out the rails so to facilitate the rails to be once again inserted into the bearing carrier and further guided into the linear tract of the roller.

The prior art to locate the bearing carrier at the front end of the rails having been taught in Taiwanese Publication Nos. 252316 (please refer to the Background of U.S. Pat. No. 5,577,821), 491054(U.S. Pat. No. 6,454,372), 491055, 498730 (U.S. Pat. Nos. 5,722,750 and 6,220,683), M248319 (U.S. Pat. No. 6,145,945), M268985, and Invention Early Publication No. 200412881 in Taiwan; and U.S. Pat. Nos. 3,801,166, 4,252,382, 5,466,060, 5,577,821, 5,722,750, 6,145,945, 6,220,683 B1, 6,254,210 B1, 6,296,338 B1, 6,390,575 B1, 6,655,763 B2, 6,715,851 B1, 6,820,954 B2, 6,851,773 B2, and 6,860,574 B2; U.S. patent Early Publication Nos. US 2002/0089273 A1, US 2005/0017613 A1, and US 2005/0062379 A1; and Japanese is Patent Nos. 5-15790 and 2562231 is also the prior art that the applicant of the present invention is familiar with.

Whereas, most of the locators of the prior arts, as described above relate to a "temporary" elasticity retaining function, the bearing carrier is vulnerable to displacement by accident; while the others providing with enforcing locating functions are found with the flaw that the releasing mechanism adapted to the locator was old fashion.

SUMMARY OF THE INVENTION

In order to solve the problems, this invention provides a positioning device for a drawer slide bearing carrier comprising a bearing carrier having rollers disposed between a carrying rail and a sliding rail. The bearing carrier comprises a recess and a hook portion at a front end thereof. The carrying rail comprises a support at a front end thereof for the sliding rail to slide along there. The support comprises a hook unit which is pivotally connected to a block fixed on the carrying rail. An elastic force is formed between the support and the hook unit, urging the hook unit to restore its original position. When the bearing carrier moves to the position where the support is and is detached from the sliding rail, the front end of the bearing carrier is pressed by the block and the hook portion engages with the hook unit to restrain further movement. The sliding rail comprises at least a releasing mechanism which controls the swing of the hook unit for the movement of different positions when the sliding rail is pulled to its extremity with respect to the carrying rail or when the carrying rail is inserted into the sliding rail.

The positioning status of the bearing carrier engaging with the hook unit can be disengaged by applying an appropriate force. Under this circumstance, this invention further comprises a restrictor on the sliding rail. The restrictor urges the hook unit to engage with the bearing carrier when the sliding rail is inserted into the carrying rail. When the sliding rail is further inserted into the carrying rail, the restrictor detaches from the hook unit. The engagement of the hook unit and the bearing carrier may be released by a friction force from the sliding rail and the bearing carrier. Alternatively, the releasing mechanism urges the hook unit to release the engagement. Thus, the disengagement effect permits the sliding rail to continue guiding the carrying rail and the bearing carrier.

It is the primary object of the present invention to provide a positioning device for a drawer slide bearing carrier, which positions a bearing carrier securely.

It is another object of the present invention to provide a positioning device for a drawer slide bearing carrier, which provides a block to protect a hook unit from being damaged.

It is a further object of the present invention to provide a positioning device for a drawer slide bearing carrier, which provides various operations of the hook unit to enhance the retaining purpose and to make the bearing carrier easier to control.

DETAILED DESCRIPTION OF THE PREFERRED EMBODIMENTS

Figure 1:
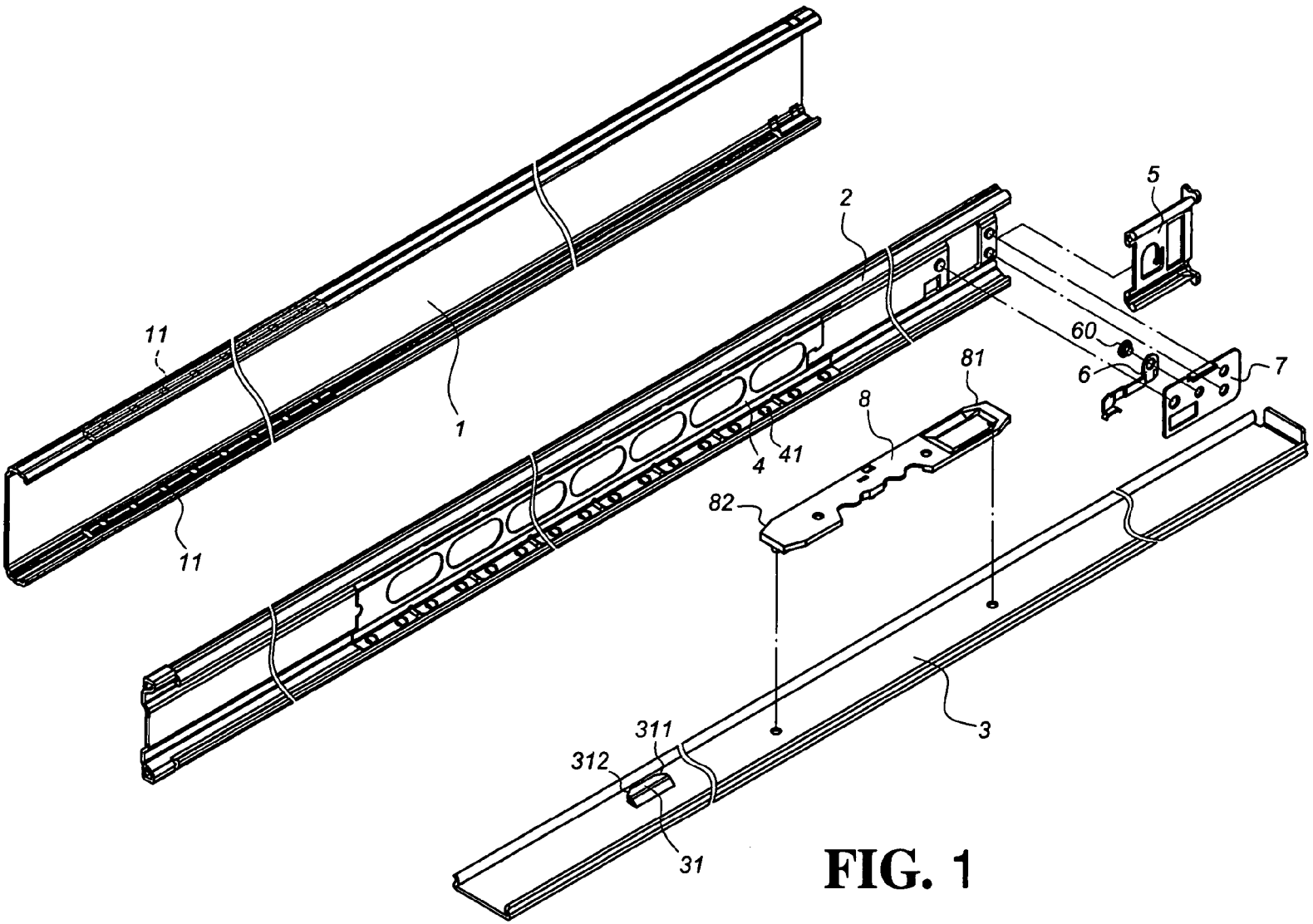
FIG. 1 is an exploded view of a first embodiment of the present invention.

FIG. 1 shows a preferred embodiment of a positioning device for a drawer slide bearing carrier of the present invention. The drawer slide is generally a three-part drawer slide which comprises a fixed rail 1, a carrying rail 2, and a sliding rail 3. Two ball bearings 11 are disposed between the fixed rail 1 and the carrying rail 2, while a bearing carrier 4 with rollers 41 is disposed between the carrying rail 2 and the sliding rail 3. If the drawer slide is a two-part drawer slide, either of the fixed rail 1 or the carrying rail 2 can be selected to operate along with the sliding rail 3 and the bearing carrier 4. There are a few prior arts disclosed this design, hence, the description of this design will not be given hereinafter.

Figure 2:
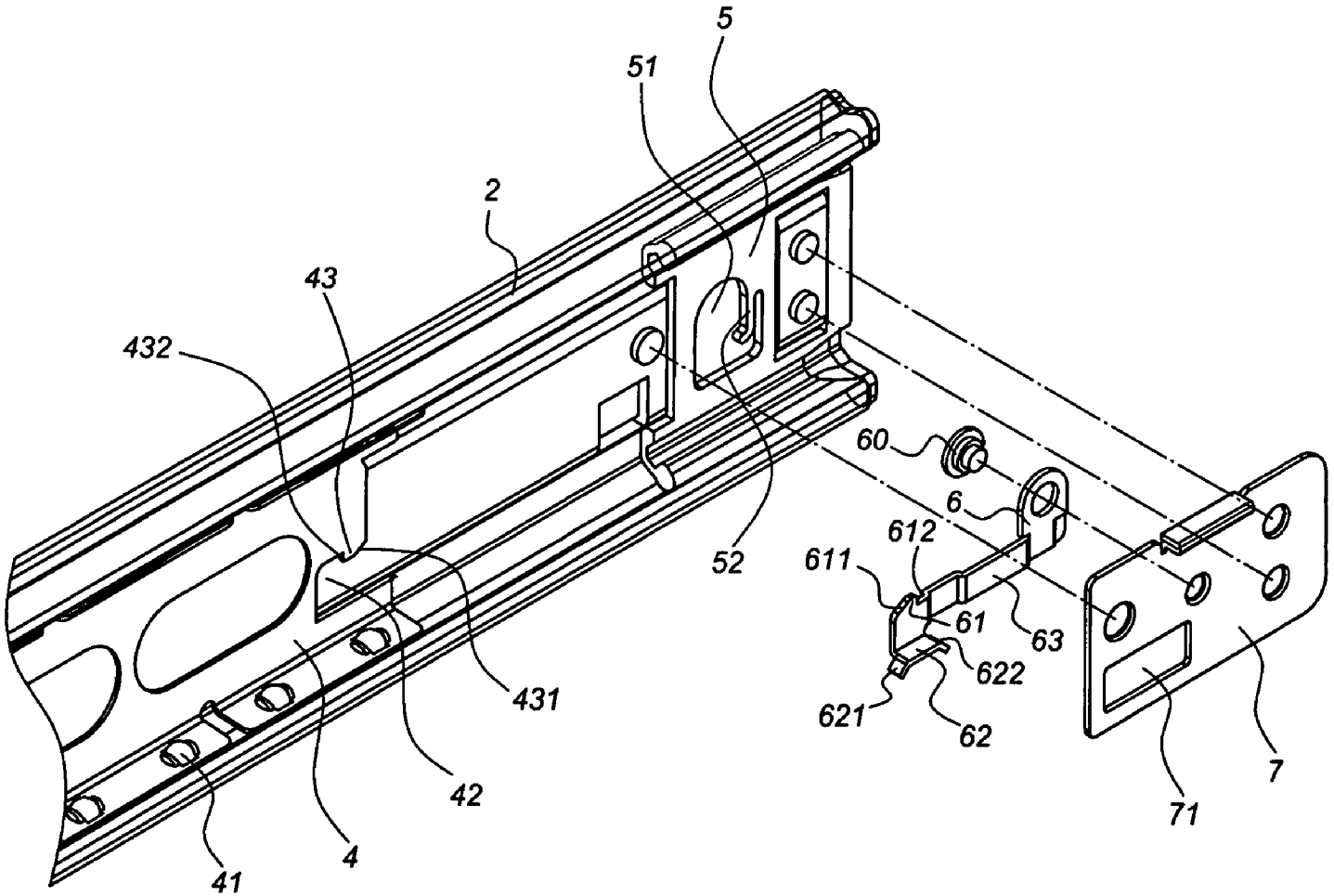
FIG. 2 is a partially enlarged view of the first embodiment of the present invention.

The bearing carrier 4, as shown in FIG. 2, has a recess 42 at a front end thereof. One inner side of the recess 42 is formed with a hook portion 43. The hook portion 43 has an oblique surface 431 at a front end thereof and a vertical surface 432 at a rear end thereof.

The carrying rail 2 comprises a support 5 secured to a front end thereof adapted for the sliding rail 3 to lean on and to slide. A hook unit 6 is provided corresponding to the position of the support 5. The hook unit 6 is pivotally connected to a block 7 with a pin 60 and is able to swing. The block 7 is secured to the front end of the carrying rail 2 and covers a portion of the support 5. In between the support 5 and the hook unit 6, there is formed with an elastic force which urges the hook unit 6 to restore its original position after swinging. The support 5 has a through hole 51 and an elastic rod 52 formed at an inner side of the through hole 51. The elastic rod 52 engages with one side of the pivot center of the hook unit 6. The hook unit 6 has a hook body 61 at the other side opposite the elastic rod 52. The hook body 61 has an oblique surface 611 at an outer end thereof and a vertical surface 612 at an inner end thereof. The hook body 61 is provided with a tab 62 bending from one side of the hook body 61. The tab 62 comprises a pair of slanting flanges 621 and 622 at front and rear ends thereof. The hook unit 6 is formed with a protruding arm 63 to seat on the edge of the support 5. The hook body 61 has the same height as the protruding arm 63. The block 7 has an opening 71 adapted for the protruding arm 63 to extend therein.

The sliding rail 3 comprises at least a disengaging unit, as shown in FIG. 1. A first disengaging unit 8 is a rectangle-like shape having a pair of oblique surfaces 81 and 82 at front and rear ends thereof, and is riveted to the inner surface of the sliding rail 3 corresponding to the position of the support 5 when the sliding rail 3 is pulled to the extremity. Furthermore, the inner surface of the sliding rail 3 may be formed with a second disengaging unit 31 which can be a bulge plate punching from the sliding rail 3 itself. The disengaging unit 31 has a pair of oblique surfaces 311 and 312 at front and rear ends thereof, and is disposed close to the rear end of the sliding rail 3.

Figure 3:
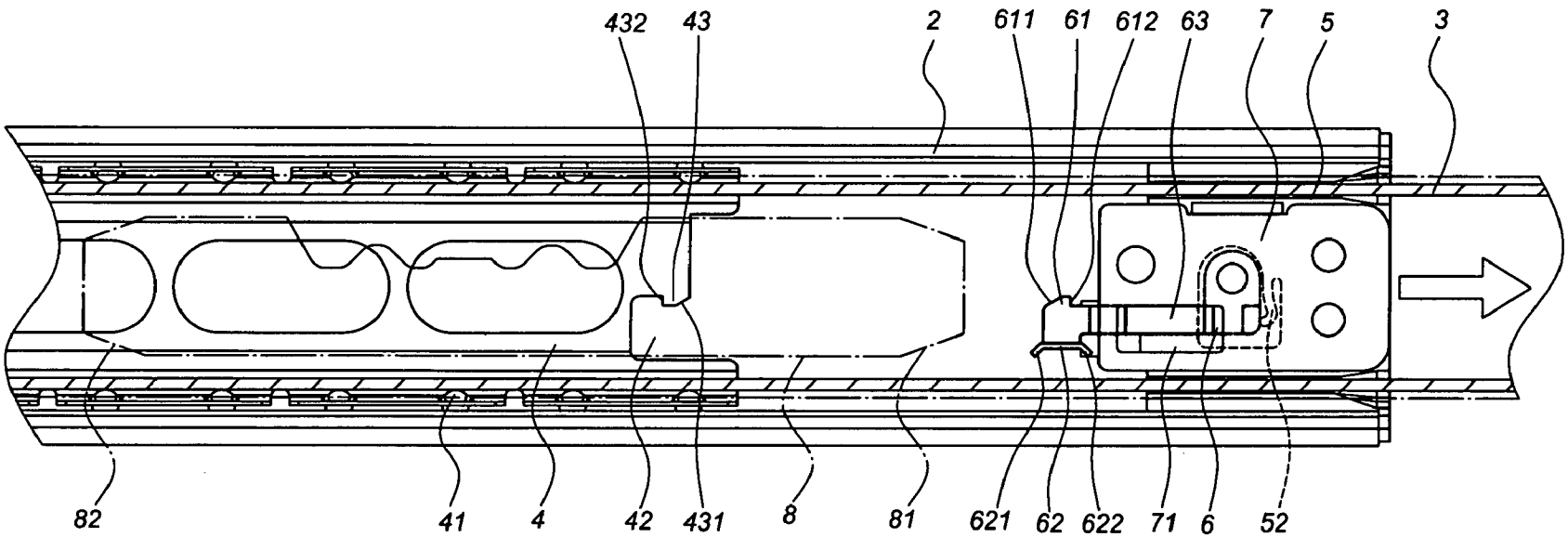
FIG. 3 is a side cross-sectional view of the first embodiment of the present invention showing a first pulling status.
Figure 4:
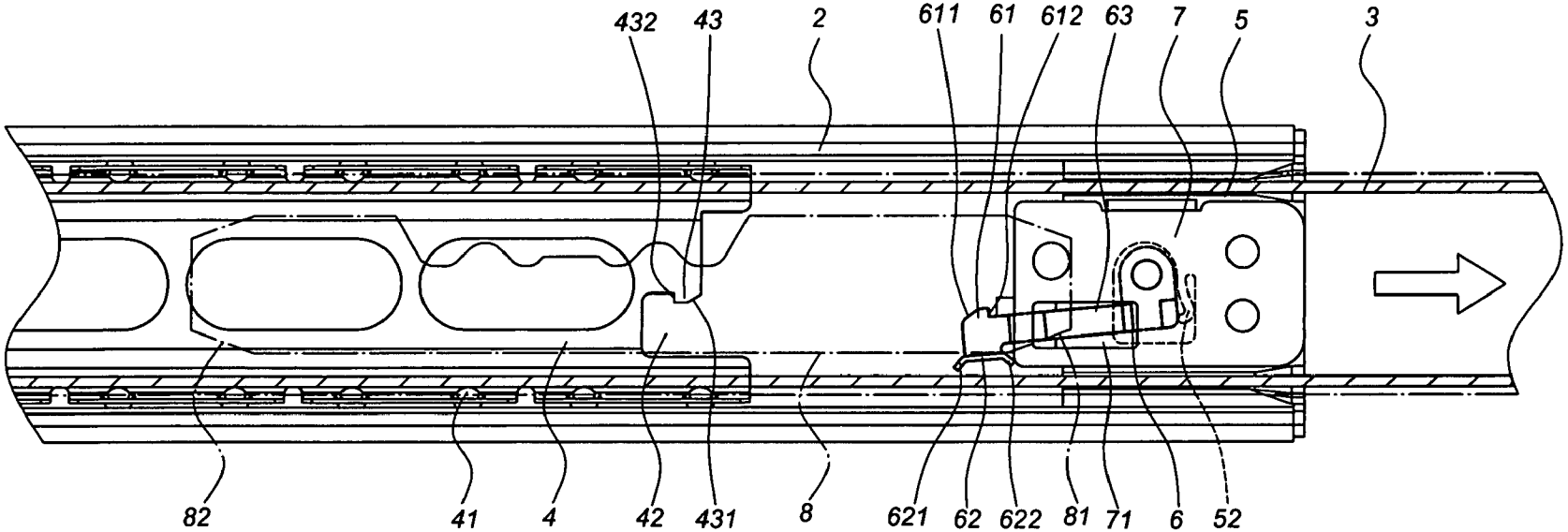
FIG. 4 is a side cross-sectional view of the first embodiment of the present invention showing a second pulling status.

With the above design, when the sliding rail 3 is pulled away from the carrying rail 2, the rollers 41 of the bearing carrier 4 are rolling media to the sliding rail 3. Both the sliding rail 3 and the bearing carrier 4 are linking to move, however, the sliding rail 3 moves to a distance which is almost the double of the bearing carrier 4, which has a precise measurement that when the sliding rail 3 reaches to its extremity, the bearing carrier 4 will reach to the support 5. As shown in FIG. 3, when the sliding rail 3 is pulled to a certain distance, before the bearing carrier 4 reaches to the support 5, the front end of the first disengaging unit 8 overpasses the bearing carrier 4 and is in touch with the hook unit 6. When the front end of the first disengaging unit 8 engages with the hook unit 6, as shown in FIG. 4, the front oblique surface 81 will engage with and slide along the tab 62 of the hook unit 6, which pushes the hook unit 6 to swing and to move the hook body 61 away from its original position.

Figure 5:
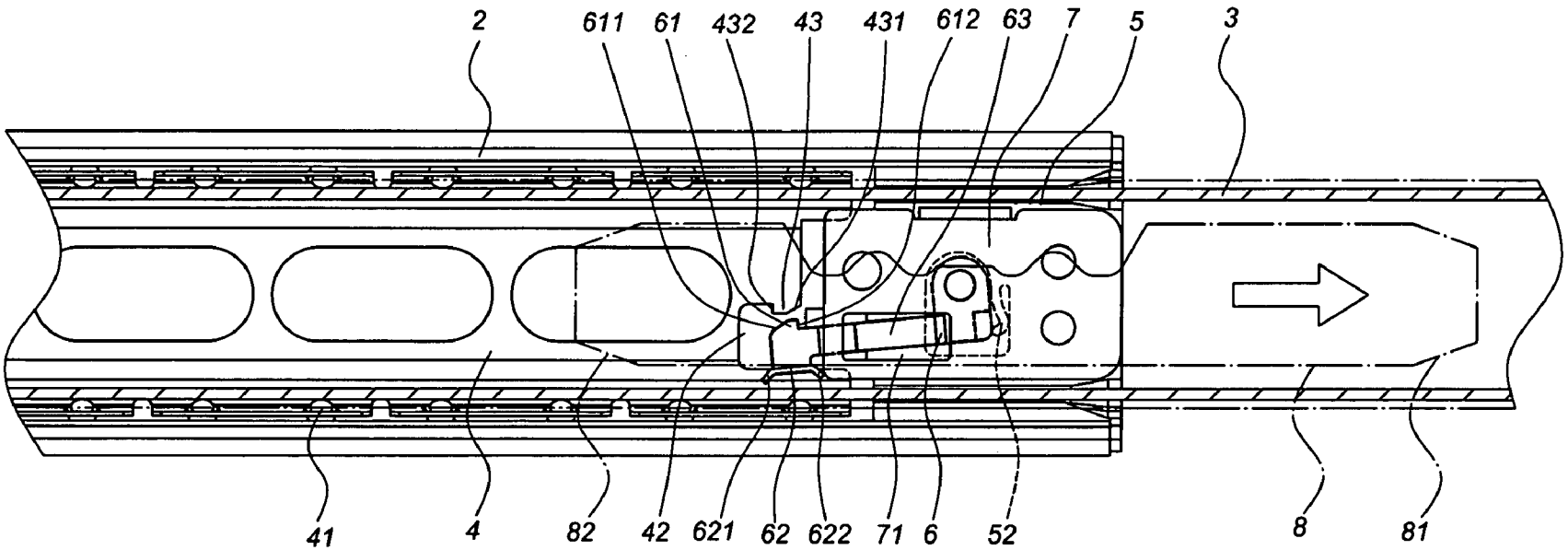
FIG. 5 is a side cross-sectional view of the first embodiment of the present invention showing a third pulling status.

When the sliding rail 3 reaches to its extremity as shown in FIG. 5, (the pulling and locating mechanism of this operation is not in the scope of this invention, therefore, will not be described hereinafter) the first disengaging unit 8 continues contact with the hook unit 6, which keeps the hook body 61 in a slating status. Whereas the bearing carrier 4 is almost reaching to the support 5, in this Figure, there is a gap between the bearing carrier 4 and the support 5. It is an alternative way of this invention, if the bearing carrier 4 has to be in contact with the support 5. The first disengaging unit 8 keeps the hook body 61 from contact with the hook portion 43. Thus, the bearing carrier 4 maintains a free movement status, and the sliding rail 3 may be pulled or pushed with respect to the carrying rail 2 freely.

Figure 6:
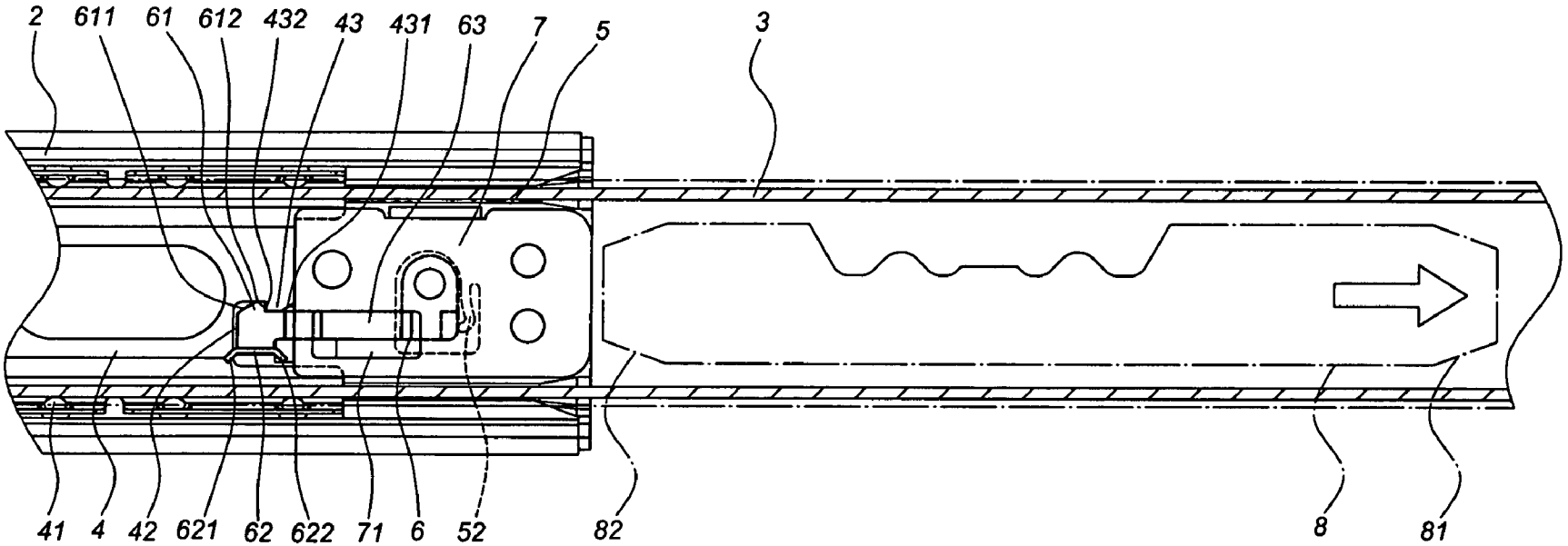
FIG. 6 is a side cross-sectional view showing the detachment of a sliding rail with respect to a carrying rail of the first embodiment of the present invention.
Figure 7:
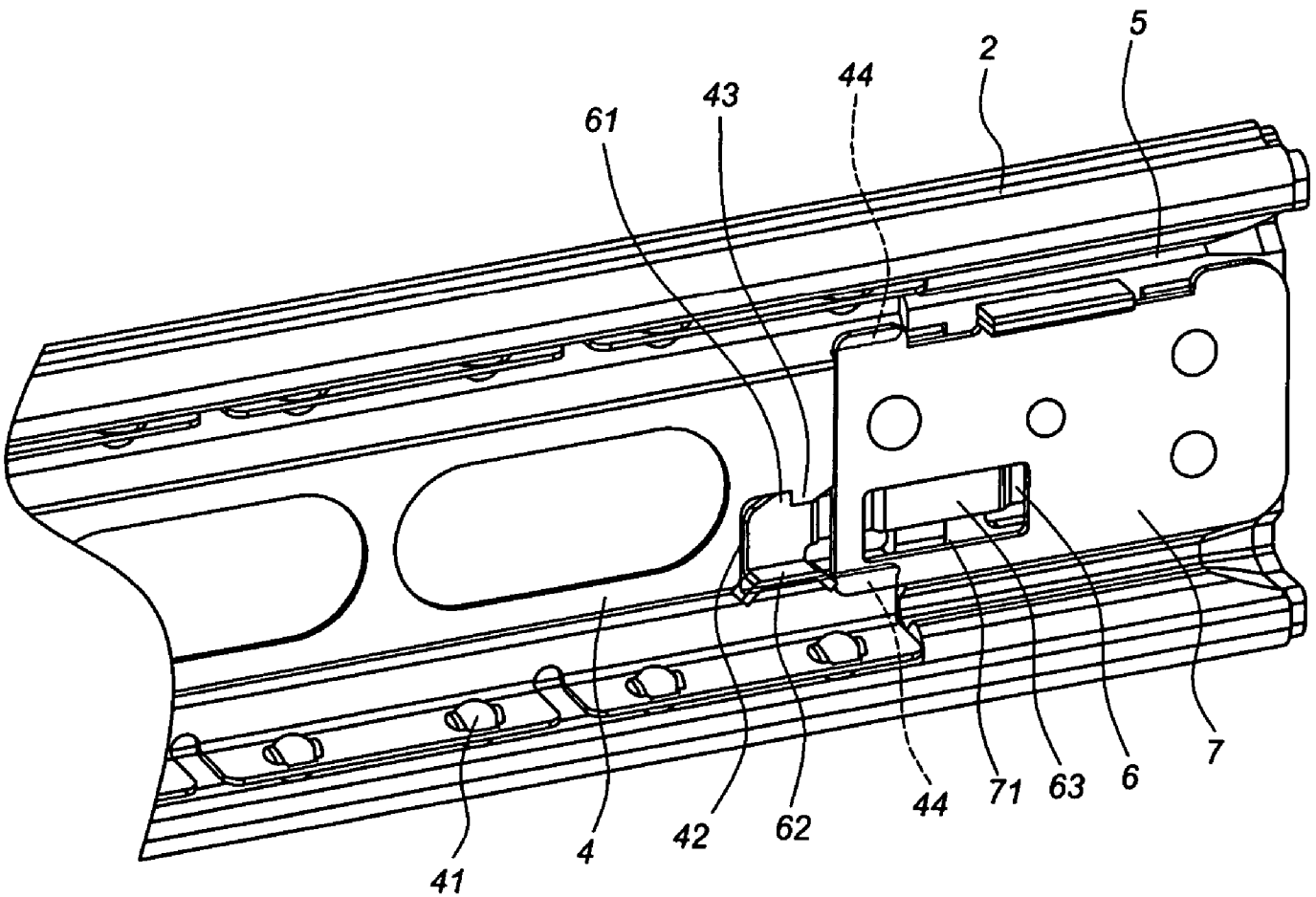
FIG. 7 is a side view of the first embodiment of the present invention showing a bearing carrier in a positioned status.

When the sliding rail 3 is fully pulled away with respect to the carrying rail 2, as shown in FIG. 6, the bearing carrier 4 will be in contact with the support 5. After the first disengaging unit 8 detaches from the hook unit 6, the hook body 61 will engage with the hook portion 43 of the bearing carrier 4 to secure the bearing carrier 4 from retreat.

Two edges 44 provided at respective sides of the front end of the bearing carrier 4 at this moment are inserted into the bottom of the rear end of the block 7 and are secured thereat, thus preventing the hook portion 43 of the bearing carrier 4 from movement in a normal direction, which is to ensure the hook portion 43 engaging with the hook body 61. When the sliding rail 3 is disengaged from the carrying rail 2, the bearing carrier 4 is located firmly to the support 5.

Figure 8:
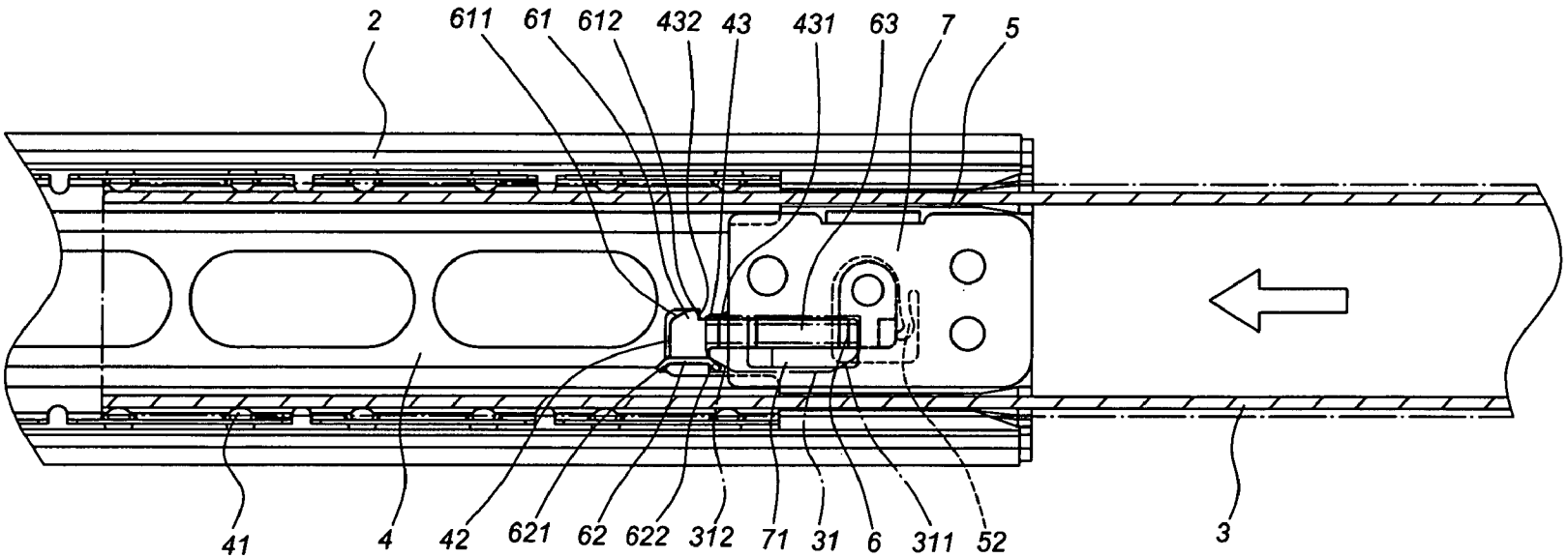
FIG. 8 is a side cross-sectional view showing a first step of insertion of the sliding rail into the carrying rail of the first embodiment of the present invention.
Figure 9:
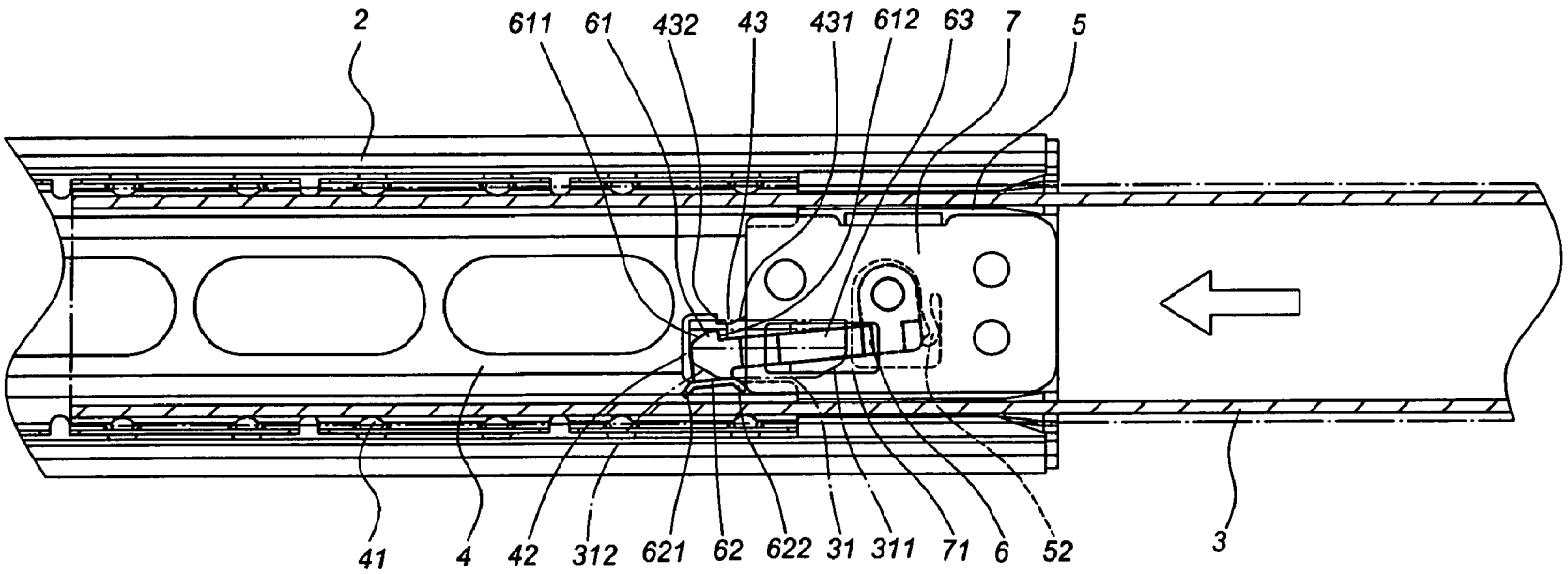
FIG. 9 is a side cross-sectional view showing a second step of insertion of the sliding rail into the carrying rail of the first embodiment of the present invention.
Figure 10:
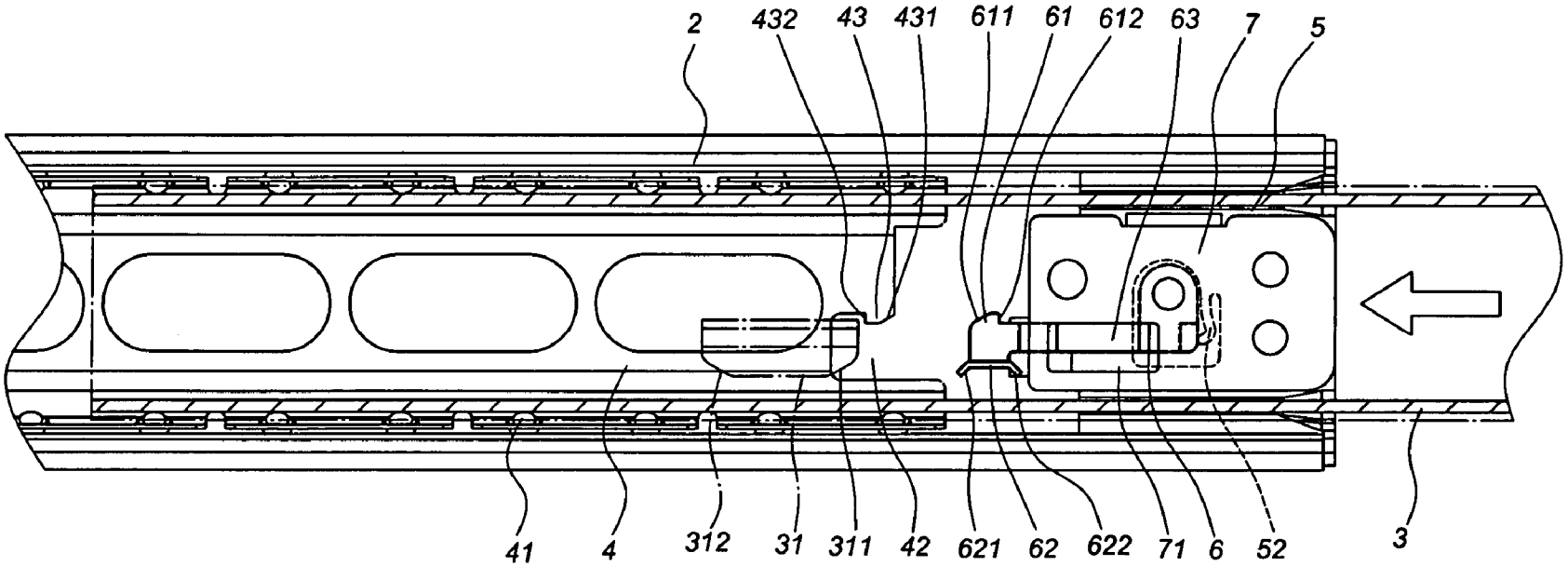
FIG. 10 is a side cross-sectional view showing a third step of insertion of the sliding rail into the carrying rail of the first embodiment of the present invention.

When the sliding rail 3 is inserted into the carrying rail 2, as shown in FIG. 8, the rear section of the sliding rail 3 passes the support 5 with a portion of which inserted into the bearing carrying rail 4. Whereas the second disengaging unit 31 of the sliding rail 3 has its rear oblique surface 312 in touch with the tab 62 of the hook unit 6 and presses the tab 62, as shown in FIG. 9, the hook body 61 will be led and linked to disengage with the hook portion 43 of the bearing carrier 4 so as to release the positioning status of the bearing carrier 4. With continuous movement of the sliding rail 3 towards the bearing carrier 4, the bearing carrier 4 is carried to slide simultaneously, as shown in FIG. 10.

Figure 11:
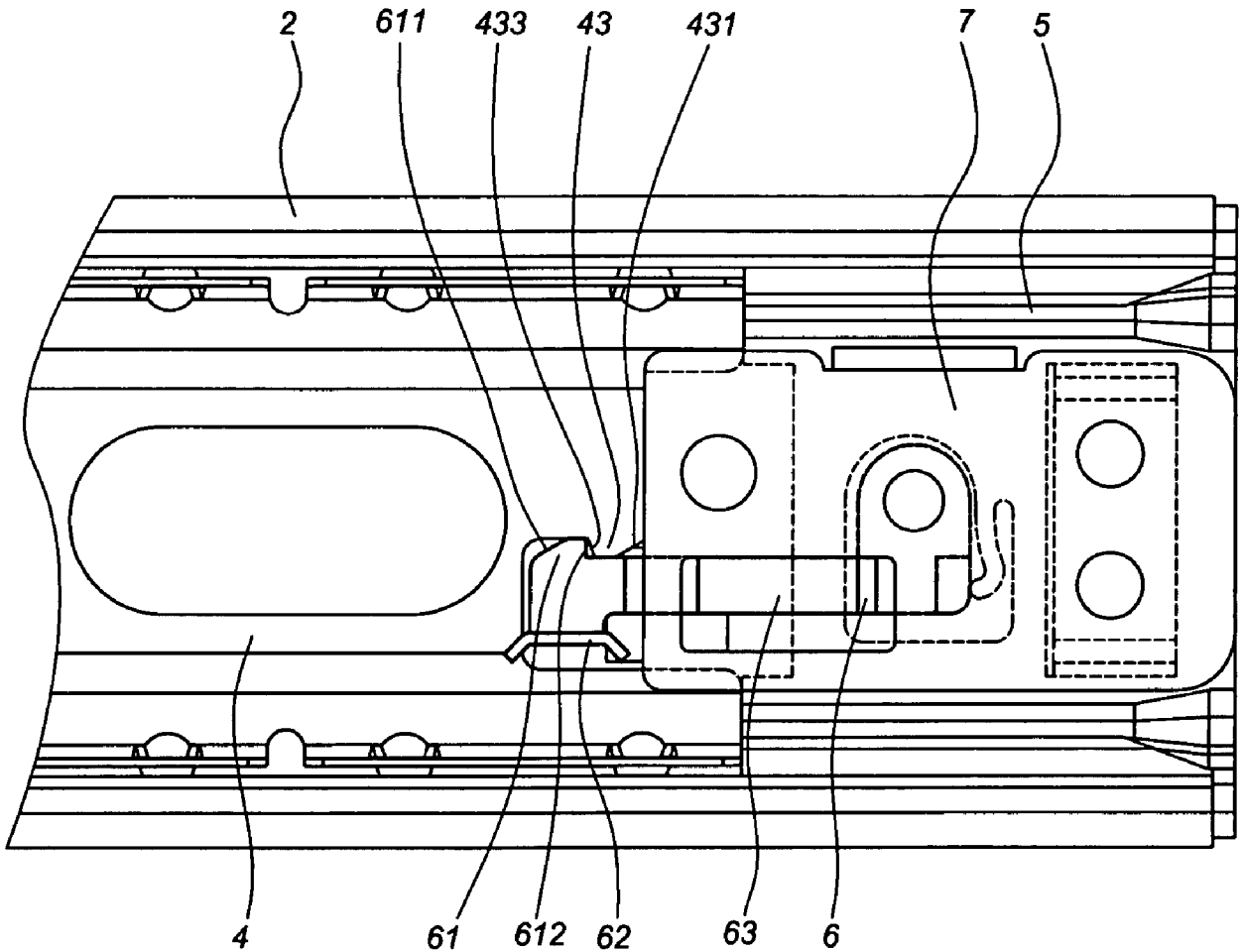
FIG. 11 is a partial view of a second embodiment of the present invention.
Figure 12:
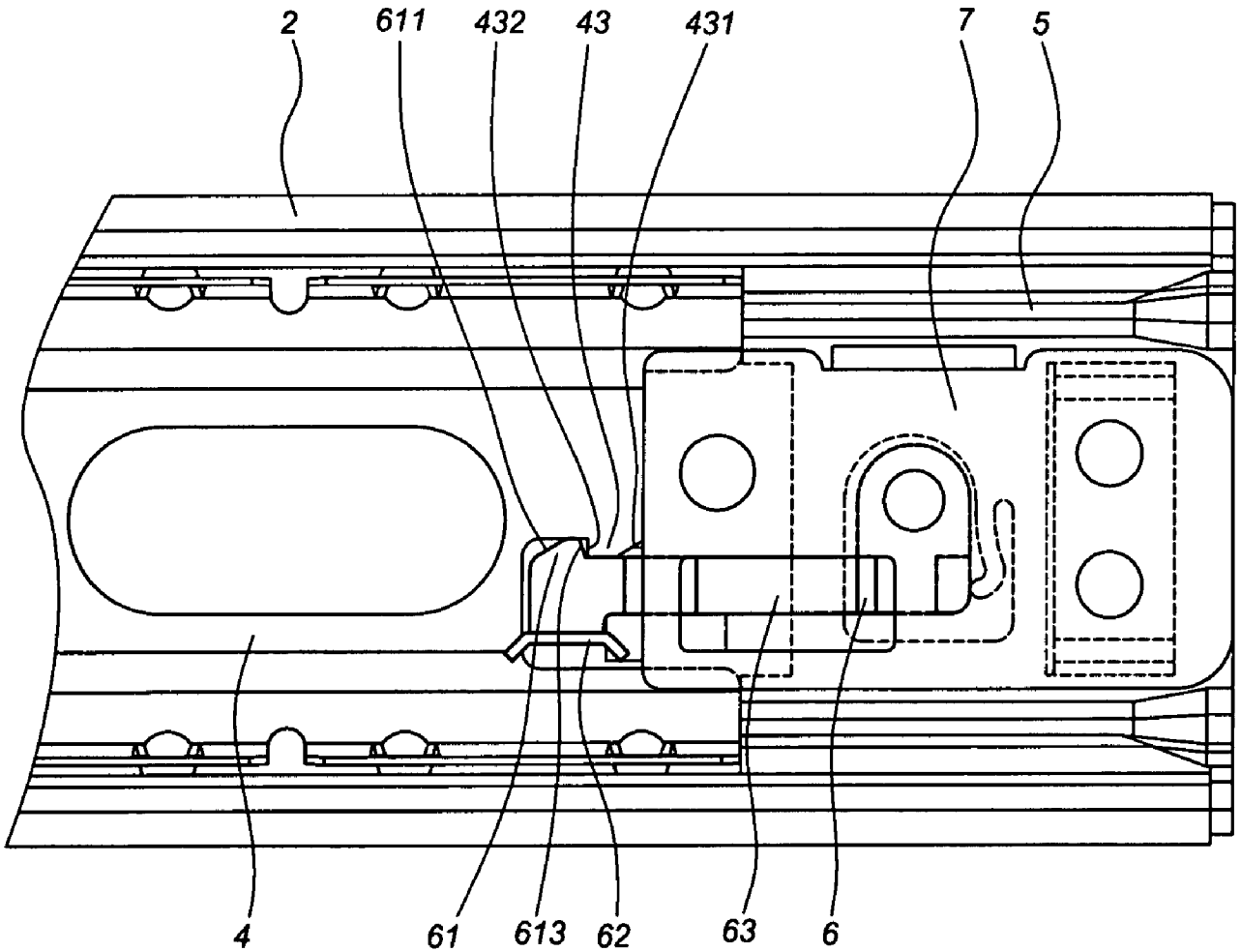
FIG. 12 is a partial view of a third embodiment of the present invention.
Figure 13:
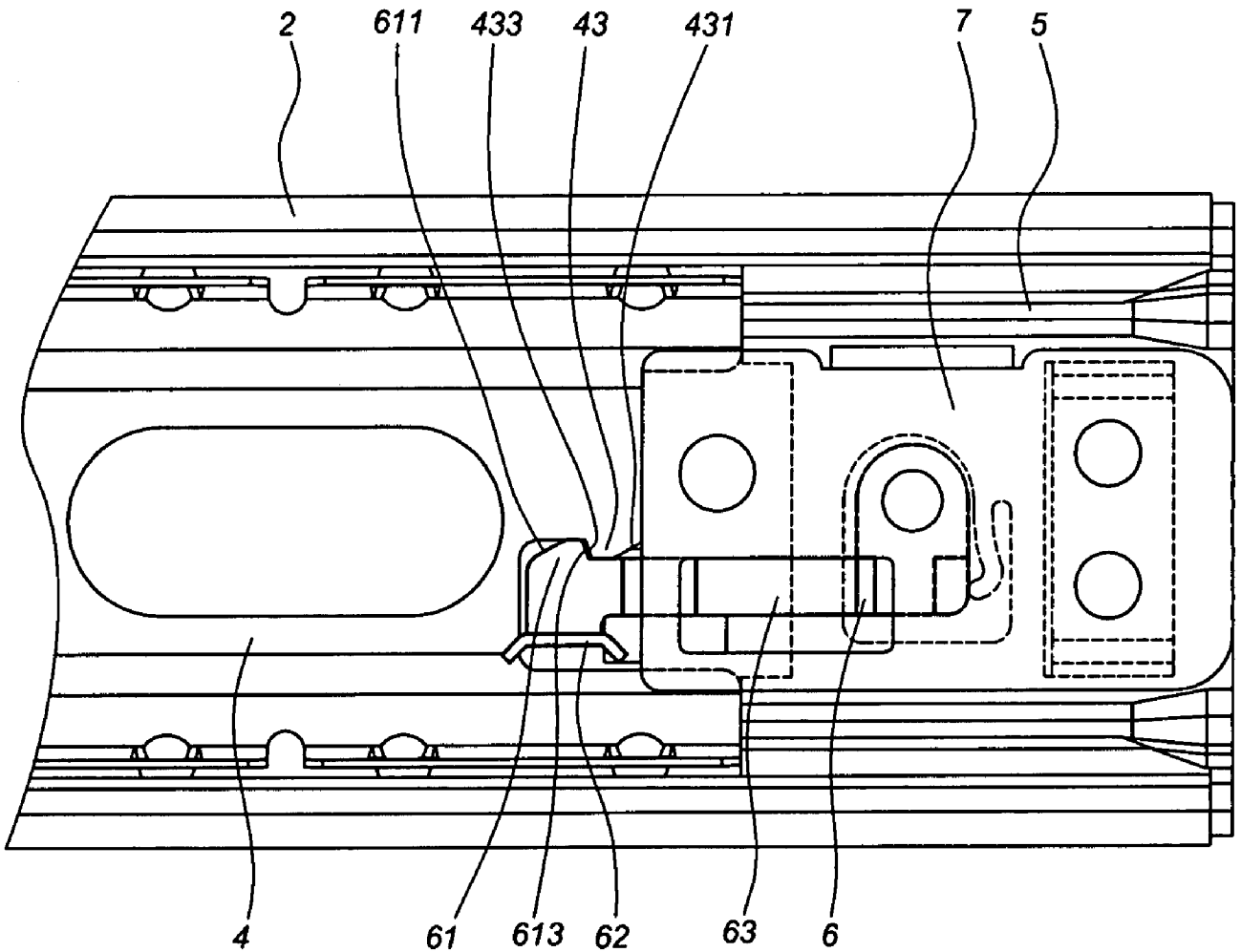
FIG. 13 is a partial view of a fourth embodiment of the present invention.

Furthermore, the positioning status of the bearing carrier 4 by means of engagement with the hook unit 6, which can be disengaged by applying an appropriate force. As shown in FIG. 11, the rear end of the hook portion 43 of the bearing carrier 4 is formed with an oblique surface 433. As shown in FIG. 12, the inner end of the hook body 61 of the hook unit 6 is formed with an oblique surface 613. As shown in FIG. 13, both of the hook portion 43 of the bearing carrier 4 and the hook body 61 of the hook unit 6 comprise oblique surfaces 433 and 613, respectively. With the above-mentioned design changes, the engagement between the hook portion 43 and the hook body 61, the engagement and disengagement can be well controlled.

Figure 14:
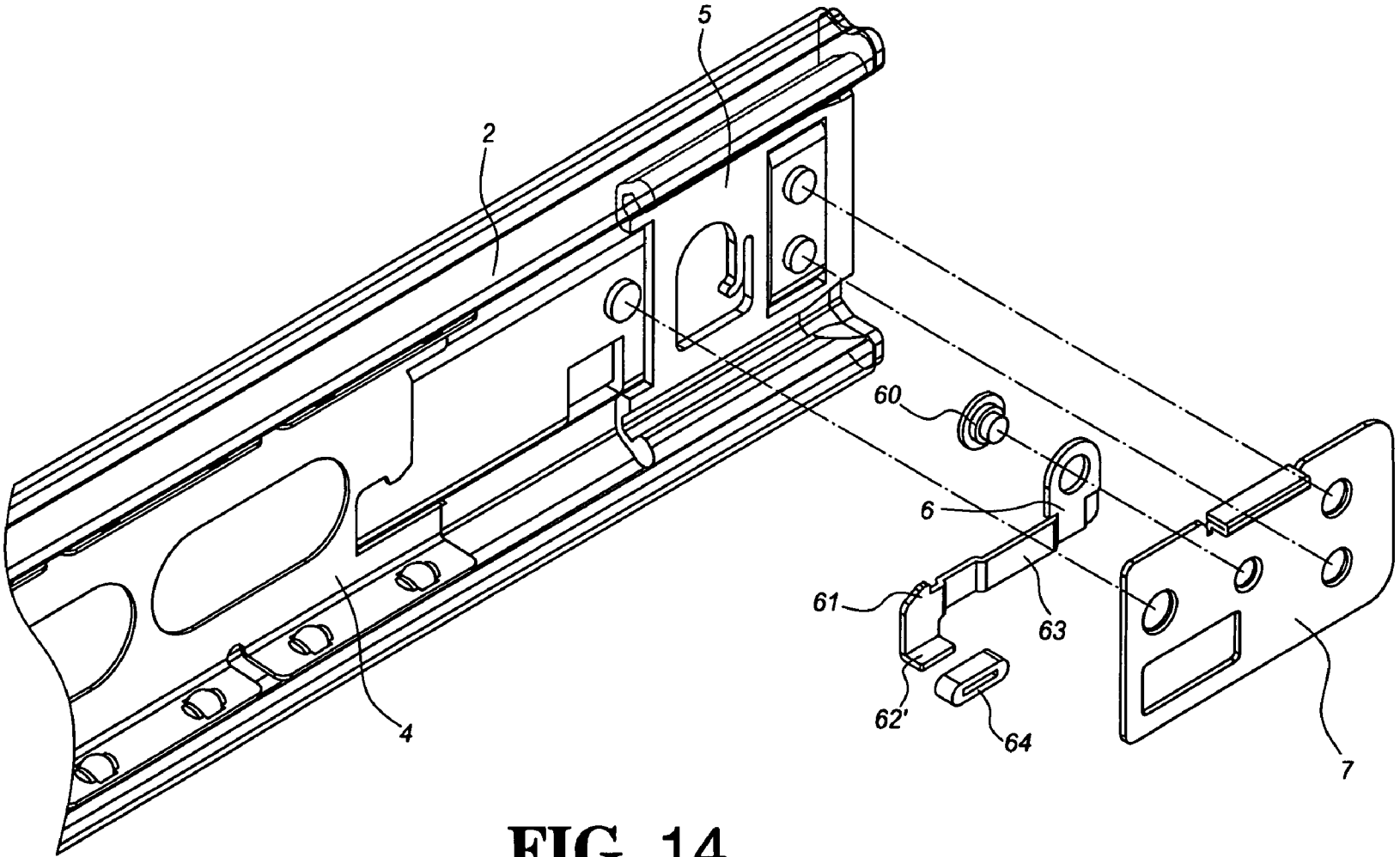
FIG. 14 is a partially exploded side view of a fifth embodiment of the present invention.
Figure 15:
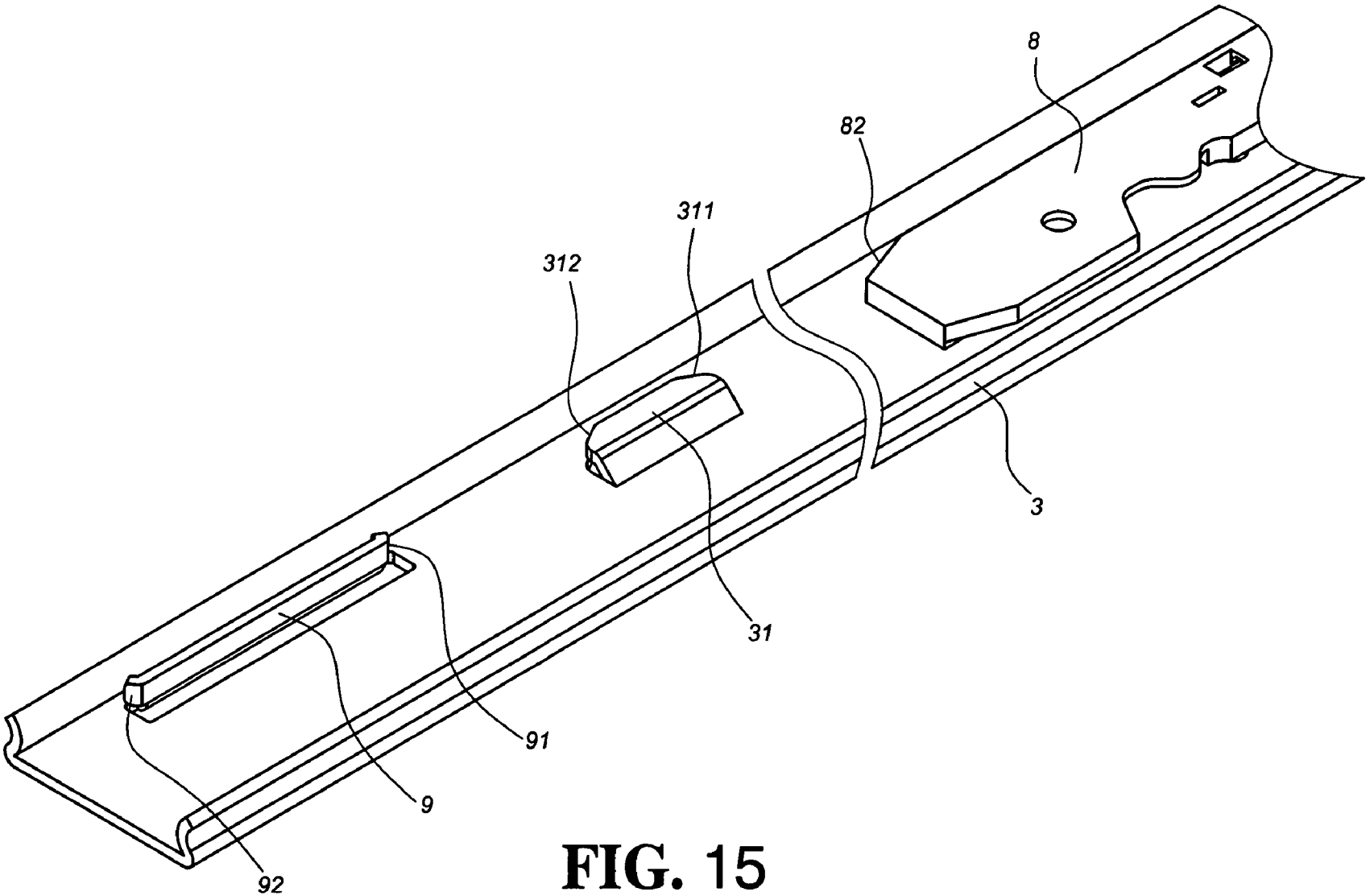
FIG. 15 is a partially perspective view of the fifth embodiment of the present invention.
Figure 16:
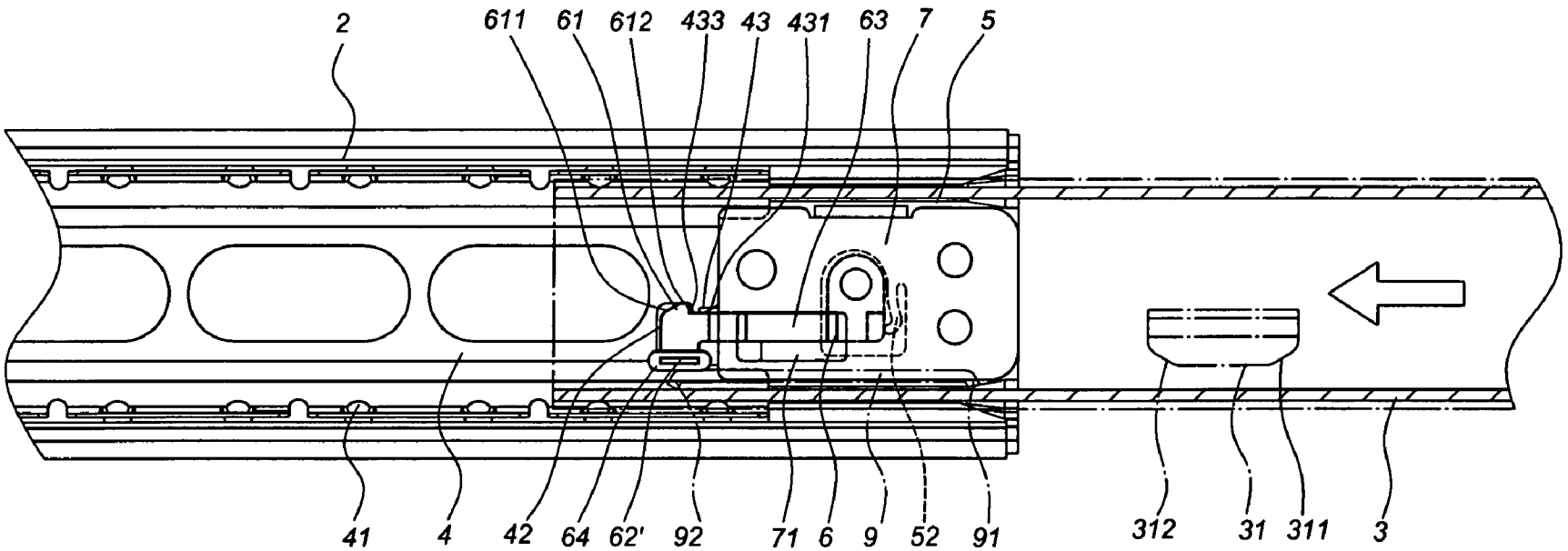
FIG. 16 is a side cross-sectional view of the fifth embodiment of the present invention in an inserting status.
Figure 17:
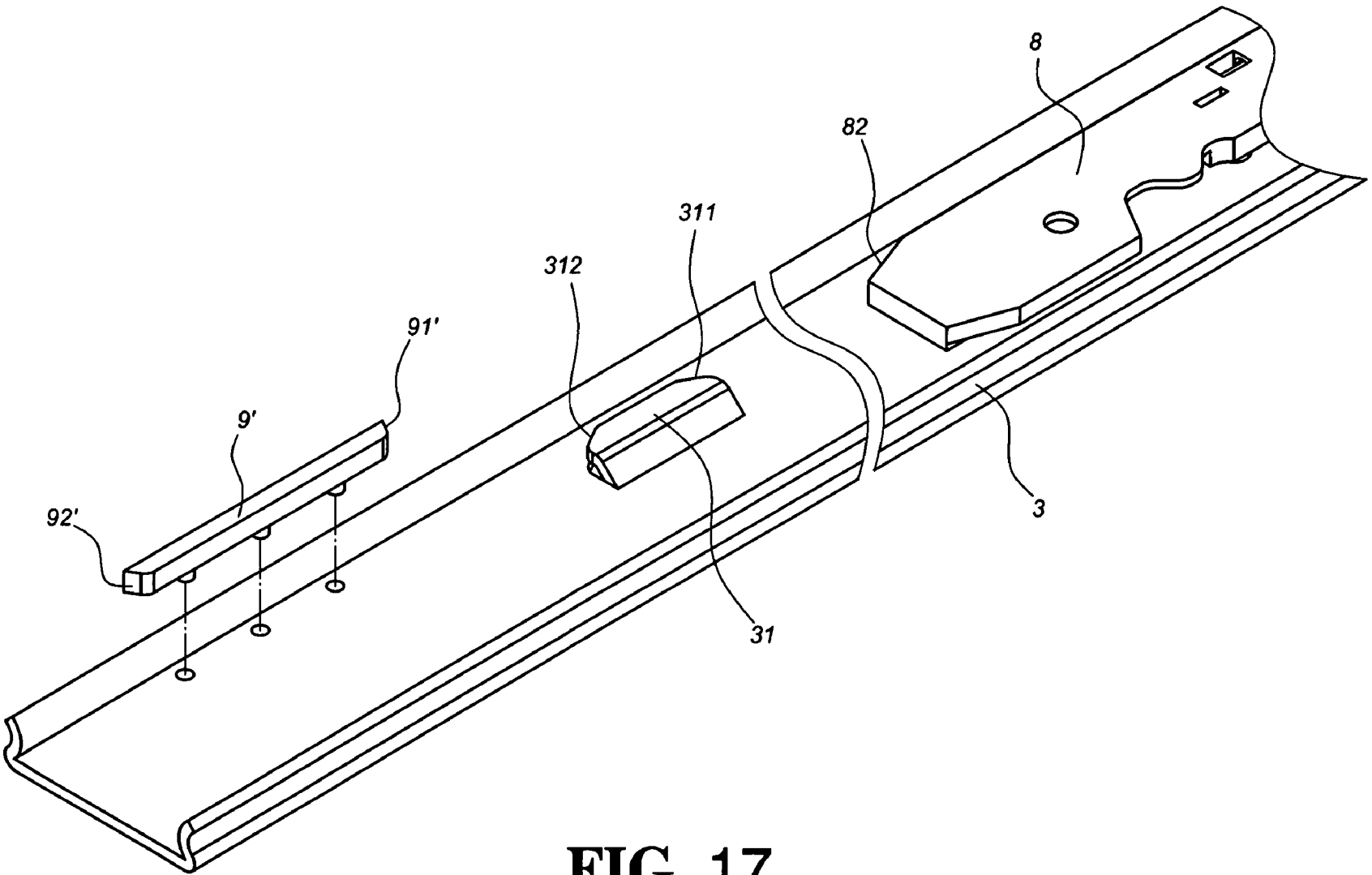
FIG. 17 is a partially perspective view of a sixth embodiment of the present invention.

FIG. 14 shows another design of the hook unit 6. A tab 62' of the hook unit 6 is provided with a sleeve 64. The sliding rail 3 comprises a restrictor 9 thereon, as shown in FIG. 15. The restrictor 9 is a pressing plate formed integrally to the rear end of the sliding rail 3. The restrictor 9 has a pair of oblique surfaces 91 and 92 at front and rear ends thereof. Alternatively, a restrictor 9' is set on the rear end of the sliding rail 3, as shown in FIG. 17. The restrictor 9' has a pair of oblique surfaces 91' and 92' at front and rear ends thereof. Take the restrictor 9 as shown in FIG. 16 as example, when the sliding rail 3 is inserted into the carrying rail 2, the rear end of the sliding rail 3 will be inserted into the bearing carrier 4. The restrictor 9 presses the sleeve 64 of the hook unit 6, which forces the hook body 61 to engage with the hook portion 43 of the bearing carrier 4, thus confining the bearing carrier 4 from self-detachment and preventing the sliding rail 3 from disengagement when the sliding rail 3 is further inserted into the bearing carrier 4. Once the restrictor 9 is detached from the sleeve 64 of the hook unit 6, the engagement between the hook body 61 of the hook unit 6 and the hook portion 43 of the bearing carrier 4 may be released by a friction force from the sliding rail 3 and the bearing carrier 4. In the event of the differential between the sliding rail 3 and the bearing carrier 4, which decreases the friction force that provides less force to release the engagement status, the second disengaging unit 31 will push the hook unit 6 to disengage the positioning status of the bearing carrier 4.

Figure 18:
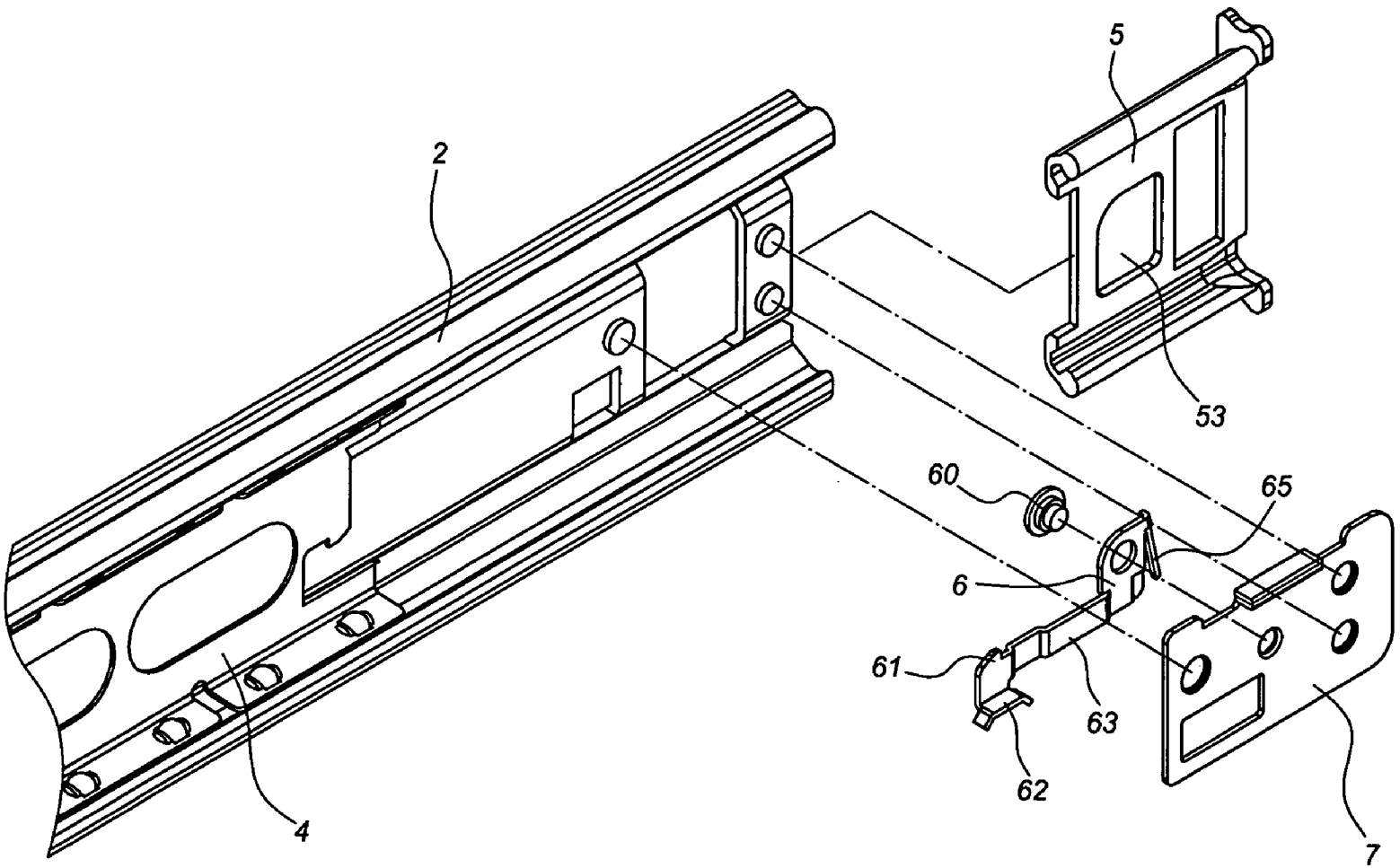
FIG. 18 is a partially exploded view of a seventh embodiment of the present invention.
Figure 19:
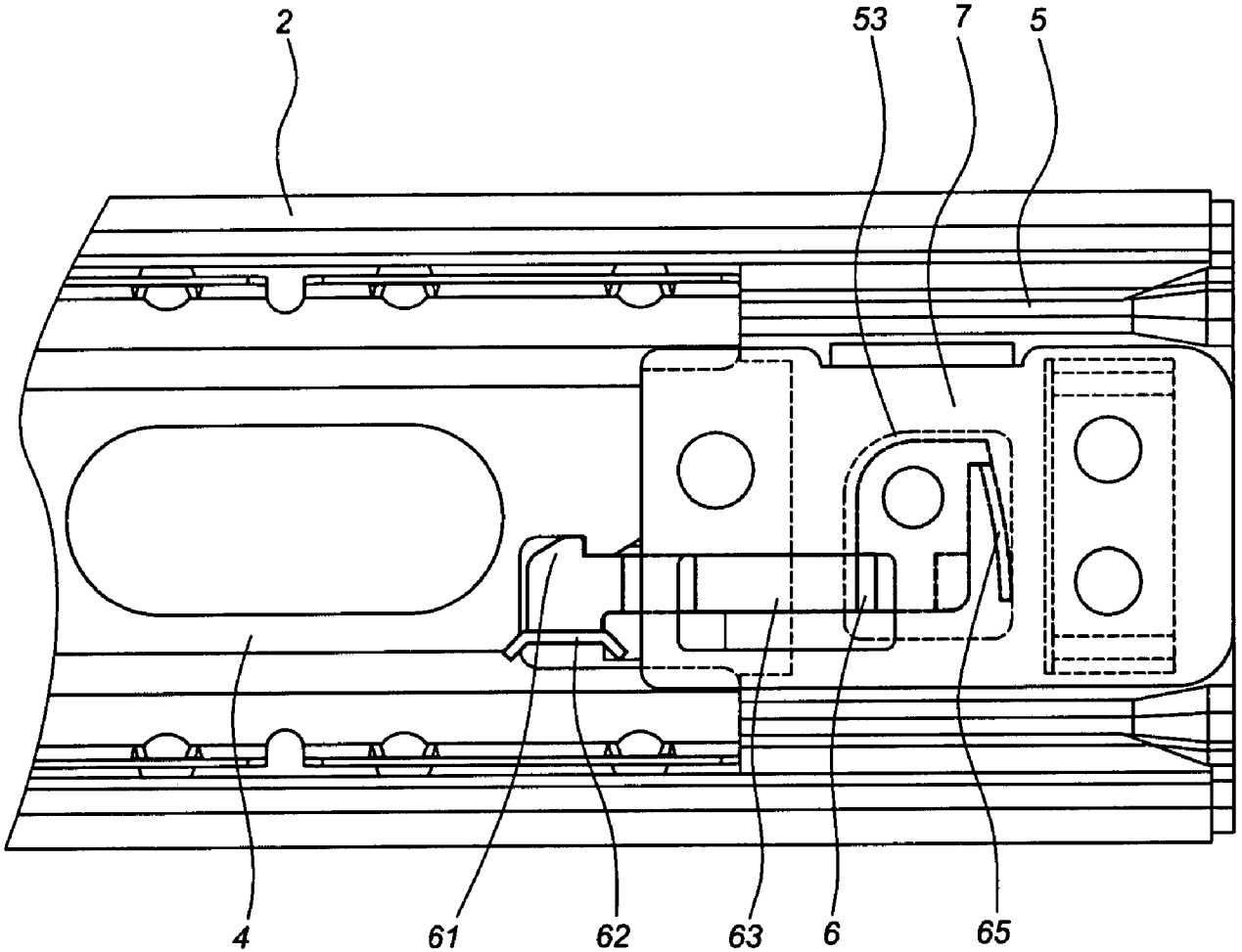
FIG. 19 is a partially cross-sectional view of the seventh embodiment of the present invention.

Furthermore, there is an elastic force between the support 5 and the hook unit 6. The actual operating means of this design is to form the elastic rod 52 on the support 5 to engage with the hook unit 6. As shown in FIGS. 18 and 19, the hook unit 6 is provided with an elastic arm 65 extending from one side of the pivot center of the hook unit 6. The elastic arm 65 will be in touch with one side of a through hole 53 of the support 5 to provide a restoring force of the hook unit 6.

What is claimed is:

1. A positioning device for a drawer slide bearing carrier comprising: a carrying rail, a sliding rail and a bearing carrier having rollers for said bearing carrier to slide between said sliding rail and said carrying rail;

said carrying rail comprising a support at a front end thereof for said sliding rail to slide along there, said support comprising a hook unit, said hook unit being pivotally connected to a block, said block being fixed to the frond end of said carrying rail and covering a portion of said support;

said bearing carrier comprising a hook portion at a front end thereof;

wherein said support further comprises a through hole and an elastic rod formed at an inner side of said through hole, said elastic rod engaging with one side of a pivot center of said hook unit, and an elastic force being formed between said support and said hook unit;

thereby, when said bearing carrier reaches to said support, the front end of said bearing carrier being pressed by said block and said hook portion engaging with said hook unit so as to position said bearing carrier.

2. The positioning device for a drawer slide bearing carrier, as recited in claim 1, wherein said hook unit comprises a hook body at one side thereof, and said hook body is provided with a tab bending from one side of said hook body.

3. The positioning device for a drawer slide bearing carrier, as recited in claim 2, wherein said hook body has an oblique surface at an outer end thereof and a vertical surface at an inner end thereof.

4. The positioning device for a drawer slide bearing carrier, as recited in claim 2, wherein said tab comprises a pair of slanting flanges at front ad rear ends thereof.

5. The positioning device for a drawer slide bearing carrier, as recited in claim 1, wherein said bearing carrier comprises a recess at the front end thereof, and said hook portion is formed at an inner side of said recess.

6. The positioning device for a drawer slide bearing carrier, as recited in claim 1, wherein said hook portion has an oblique surface at a front end thereof and a vertical surface at a rear end thereof.

7. The positioning device for a drawer slide bearing carrier, as recited in claim 1, wherein said sliding rail comprises a first disengaging unit, when said sliding rail is pulled to the extremity with respect to said carrying rail or when said sliding rail is inserted into said carrying rail, said first disengaging unit linking said hook unit to disengage with said hook portion.

8. The positioning device for a drawer slide bearing carrier, as recited in claim 7, wherein said first disengaging unit has a pair of oblique surfaces at front and rear ends thereof.

9. The positioning device for a drawer slide bearing carrier, as recited in claim 7, wherein said sliding rail further comprises a second disengaging unit at a rear end thereof, when said sliding rail is inserted into said carrying rail, said second disengaging unit pushing said hook unit to release the engagement of said hook unit and said bearing carrier.

10. The positioning device for a drawer slide bearing carrier, as recited in claim 9, wherein said second disengagement unit is a bulge plate formed in a press method and has a pair of oblique surfaces at front and rear end thereof.

* * * * *